US006598657B2

(12) United States Patent
Dodd

(10) Patent No.: US 6,598,657 B2
(45) Date of Patent: Jul. 29, 2003

(54) MOULD SUPPORT ARRANGEMENT

(75) Inventor: Alec G Dodd, Derby (GB)

(73) Assignee: Rolls-Royce ple, London (GB)

( * ) Notice: Subject to any disclaimer, the term of this patent is extended or adjusted under 35 U.S.C. 154(b) by 0 days.

(21) Appl. No.: 10/092,533

(22) Filed: Mar. 8, 2002

(65) Prior Publication Data

US 2002/0134524 A1 Sep. 26, 2002

(30) Foreign Application Priority Data

Mar. 22, 2001 (GB) ..... 0107200

(51) Int. Cl.[7] ..... B22D 27/04

(52) U.S. Cl. ..... 164/122.1; 164/122.2; 164/348

(58) Field of Search ..... 164/122.1, 122.2, 164/348, 125, 129

(56) References Cited

U.S. PATENT DOCUMENTS

| | | | | |
|---|---|---|---|---|
| 3,536,121 A | * | 10/1970 | Piearcey | 164/122.2 |
| 4,552,197 A | | 11/1985 | Mills | |
| 4,969,501 A | * | 11/1990 | Brokloff et al. | 164/122.1 |
| 5,046,547 A | * | 9/1991 | Oti | 164/122.1 |
| 5,234,047 A | * | 8/1993 | Rose | 164/358 |
| 5,275,227 A | * | 1/1994 | Staub | 164/122.1 |
| 6,003,587 A | * | 12/1999 | Mitsuhashi | 164/122.1 |

FOREIGN PATENT DOCUMENTS

| | | |
|---|---|---|
| EP | 0243095 A | 10/1987 |
| GB | 2096502 A | 10/1982 |
| GB | 2096503 A | 10/1982 |
| GB | 2266066 A | 10/1993 |

* cited by examiner

*Primary Examiner*—M. Alexandra Elve
*Assistant Examiner*—Len Tran
(74) *Attorney, Agent, or Firm*—W. Warren Taltavull; Manelli, Denison & Selter PLLC

(57) ABSTRACT

A mold support (110) is disclosed for supporting a plurality of molds (109) in a casting apparatus having a first zone for introducing molten material into the molds and a second zone in which the material in the molds can cool. The mold support (110) is capable of relative movement from the first zone to the second zone thereby forming a solidification front in the material in each mold, whereby the solidification front moves through the material as the material solidifies. Each mold (109) defines a main axis (A) along which the solidification front can move and a centrally extending plane (P) perpendicular to the main axis. The mold support (110) comprises carrying means upon which the molds (109) can be disposed. The geometry of the carrying means is such that the centrally extending plane of a first mold (109) arranged on the carrying means at or towards a central region thereof is not co-planar with the centrally extending plane of a second mold spaced from the first mold (109) away from the central region, and such that the main axis (A) of each mold (109) extends substantially perpendicular to the solidification front to be formed therein.

20 Claims, 5 Drawing Sheets

MOULD SUPPORT ARRANGEMENT

This invention relates to mould support arrangements. More particularly, but not exclusively, this invention relates to mould support arrangements in investment casting processes, for example for forming castings as single crystals.

The investment casting of components of turbine engines, for example turbine blades, can be carried out using single crystal casting. The furnaces for such casting have moulds mounted on chill plates. After the metal is poured into the moulds, the chill plate is withdrawn into a cooler part of the apparatus to provide a unidirectional solidification front perpendicular to the main axis of the mould. A starter or seed ensures that the solidification commences as a single crystal which continues to grow as the solidification front rises through the material in the mould so that the component is formed as a single crystal.

A problem associated with single crystal casting techniques is that stray grains can be formed in the solidifying material. The formation of such stray grains inevitably means that the component has to be scrapped. It has been found that the rate of scrap can be kept to an acceptable level by casting batches of components using one, or a small number of moulds. Large furnaces for casting a large number of components would be more economical, but the overall solidification front in such a furnace tends to be non-planar because the material in the moulds at the outside of the chill plates loses heat at a faster rate than the material in the moulds at the centre. As a result, there is a greater propensity for stray grains to form and, consequently, an increase in the rate of scrap.

The phrase "solidification front" used herein is intended to refer to the interface that forms the boundary between the solid and liquid phases of the solidifying material in the moulds.

According to one aspect of this invention, there is provided a mould support arrangement for supporting a plurality of moulds in a casting apparatus having a first zone for introducing molten material into the moulds and a second zone in which the material in the moulds can cool, the mould support arrangement being capable of relative movement from the first zone to the second zone thereby forming a solidification front in the material in each mould, which solidification front moves relatively through the material as the material solidifies, each mould defining a main axis along which the solidification front can move and a plane perpendicular to the main axis at the base of the mould, the mould support arrangement comprising support means to support the moulds such that the aforesaid planes of successive moulds at increasing distances from a central region of the support means are not co-planar with each other, and such that the main axis of each mould extends substantially perpendicular to the solidification front to be formed therein.

In one embodiment, the main axes of the aforesaid successive moulds may be inclined relative to each other.

In another embodiment, the geometry of the support means may be such that the aforesaid successive moulds are arranged at a lower level on the support means than moulds closer to the central region of the carrying means.

According to another aspect of this invention there is provided a mould support arrangement for supporting a plurality of moulds in a casting apparatus having a first zone for introducing molten material into the mould, and a second zone in which the material in the mould can cool, the mould support arrangement being capable of relative movement from the first zone to the second zone thereby forming a solidification front in the material in each mould, which solidification front moves through the material as the material solidifies, each mould defining a main axis along which the solidification front can move, the mould support comprising support means to support the moulds, wherein the geometry of the carrying means is such that the main axes of successive moulds at increasing distances from a central region of the support means are inclined at successively greater angles to each other, and such that the main axis of each mould extends substantially perpendicular to the solidification front to be formed therein.

The successive moulds as aforesaid may be inclined relative to each other by increasing amounts related to the distance of the mould from the central region of the support means. In one embodiment the moulds are inclined inwardly towards the central region of the support means in another embodiment, the moulds are inclined outwardly away from the central region of the support means.

In one embodiment, the support means comprises carrying means having a generally planar support surface. In another embodiment, the support means includes carrying means which may be generally concave.

The support means may include holding means to hold each mould on the carrying means. The holding means may comprise a distribution member which may include engagement means to engage the moulds and hold the moulds in their desired position on the support surface. The distribution member may be adapted to distribute the molten material to each of the moulds. The distribution member may comprise a manifold.

In another embodiment, the carrying means may comprise a plurality of stepped support faces. Successive support faces at increasing distances from the central region of the carrying means are preferably inclined successively more steeply to the horizontal than those closer to or at the central region. The central support face may be generally horizontal. In this embodiment, the carrying means may comprise the inclined stepped faces, and the support means may further include the holding means as described above.

According to another aspect of this invention, there is provided a mould support arrangement for supporting a plurality of moulds in a casting apparatus having a first zone for introducing molten material into the mould, and a second zone in which the material in the mould can cool, the mould support arrangement being capable of relative movement from the first zone to the second zone thereby forming a solidification front in the material in each mould, whereby the solidification front moves through the material as the material solidifies, each mould having a main axis, the mould support arrangement comprising support means to support the moulds, wherein the geometry of the support means is such that successive moulds arranged at increasing distances from a central region of the support means are arranged at successively lower levels, and such that the main axis of each mould extends substantially perpendicular to the solidification front to be formed therein.

Preferably, the support means comprises carrying means having a generally convex configuration. In one embodiment, the carrying means comprises a generally convex curved surface.

The support means may include holding means to hold each mould on the carrying means. The holding means may comprise a distribution member which may include engagement means to engage the moulds and hold the moulds in their desired position in the support surface. The distribution member may be adapted to distribute the molten material to each of the moulds. The distribution member may comprise a manifold.

In another embodiment, the carrying means comprises a plurality of stepped support faces. Successive support faces at increasing distances from the central region of the carrying means may be arranged at successively lower levels. Each of said stepped faces is preferably substantially horizontal.

In this embodiment, the support means may further include the holding means as described above.

The carrying means may include a chill plate. Supply means may be provided to supply a cooling fluid to the chill plate. Discharge means may also be provided to discharge said cooling fluid from the chill plate.

According to another aspect of this invention, there is provided casting apparatus comprising a mould support arranged as described above, a first zone for introducing molten material into the mould, and a second zone in which the material in the mould can cool, means for moving the mould support arrangement from the first zone to the second zone to effect solidification of the material in the mould.

According to another aspect of this invention there is provided a casting method comprising providing a mould support arrangement having support means for supporting a plurality of moulds, supporting a plurality of moulds by the support means, each mould defining a main axis along which the solidification front can move and a plane perpendicular to the main axis at the base of the mould, the mould being supported by the support means such that the said planes are not co-planar, and such that the main axis of each mould extends substantially perpendicular to a solidification front to be formed therein, introducing a molten material into the mould, cooling the moulds and the molten material to form the solidification front in the material in each mould, whereby the solidification front moves through the material as the material solidifies perpendicular to the main axis of each mould.

According to another aspect of this invention, there is provided a casting method comprising providing a mould support arrangement having support means for supporting a plurality of moulds, supporting a plurality of moulds by the support means, such that successive moulds at increasing distances from a central region of the support means are inclined at successively greater angles to each other, each mould defining a main axis along which the solidification front can move, and each mould being supported by the support means such that the main axis of each mould extends substantially perpendicular to a solidification front to be formed therein, introducing a molten material into the mould, cooling the moulds and the molten material to form the solidification front in the material in each mould, whereby the solidification front moves through the material as the material solidifies perpendicular to the main axis of the mould.

According to another aspect of this invention, there is provided a casting method comprising providing a mould support arrangement having support means for supporting a plurality of moulds, supporting a plurality of moulds by the support means, such that successive moulds arranged from increasing distances from a central region of the support means are arranged at successively lower levels, each mould defining a main axis along which the solidification front can move, and each mould being supported by the support means such that the main axis of each mould extends substantially perpendicular to a solidification front to be formed therein, introducing molten material into the mould, cooling the moulds and the molten material to form the solidification front in the material in each mould, whereby the solidification front moves through the material as the material solidifies perpendicular to the main axis of each mould.

Embodiments of the invention will now be described by way of example only, with reference to the accompanying drawings, in which.

One method of manufacturing some of the components of a gas turbine engine, for example turbine blades, is by casting. An example of such a casting method is investment casting, or "lost wax" casting. This technique is particularly suitable for providing components with a high standard finish, which would be required for turbine blades. The investment casting process involves forming a master die from an original pattern of the blade to be manufactured. A working pattern is cast in the die and the final investment mould is formed from a ceramic material around the wax pattern. The wax is then melted away. In the event that cooling passages are required in the blade, a ceramic pattern of these passages can be inserted into the final ceramic mould when the wax has been melted therefrom.

Figure 1:
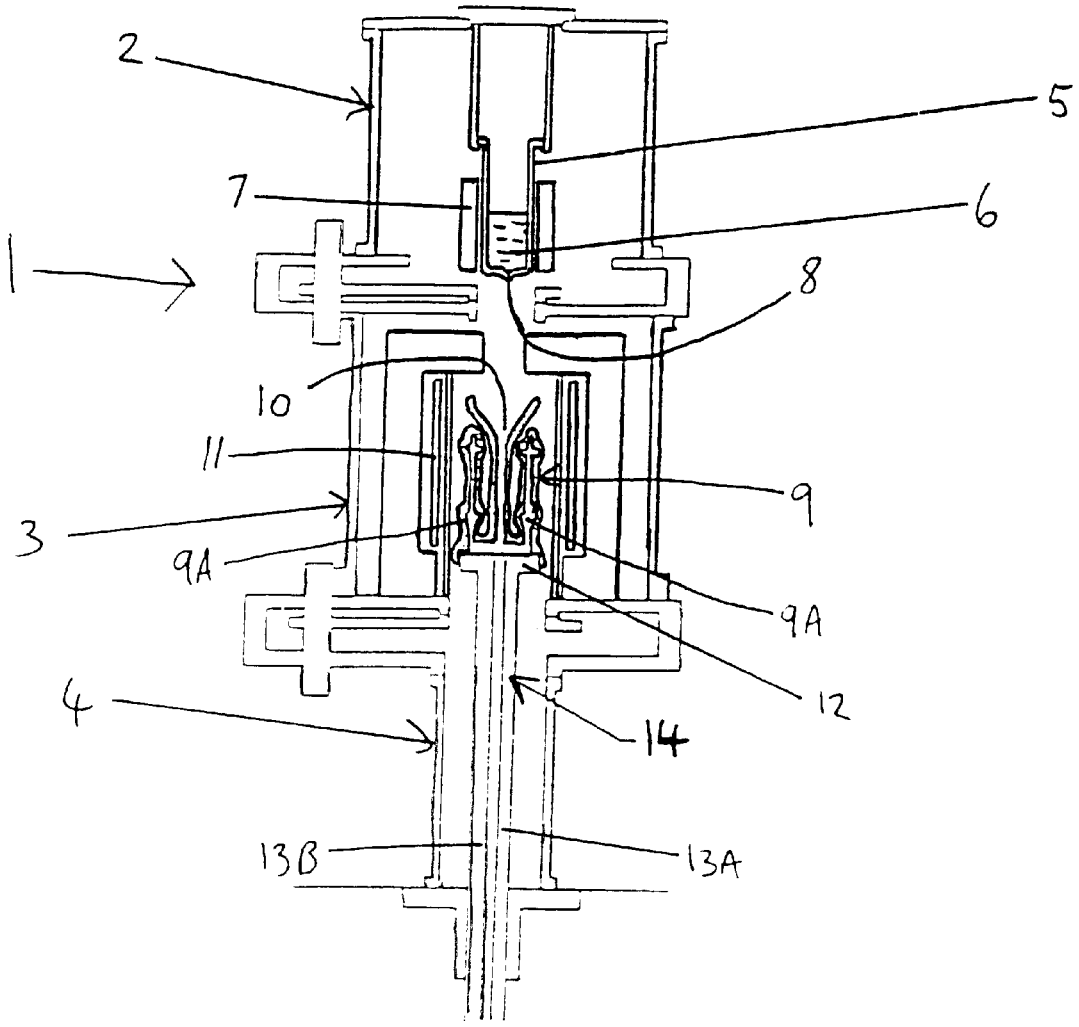
FIG. 1 is a schematic sectional side view of prior art casting apparatus.

The final ceramic mould is then arranged in a casting apparatus, an example of which is shown in FIG. 1.

Referring to FIG. 1, there is shown a prior art casting apparatus 1 which comprises a melting chamber 2, a mould chamber 3, and a withdrawal chamber 4.

In the melting chamber 2, there is provided a crucible 5 holding within it a charge 6 of the material to be melted and form the blade. A high frequency heating coil 7 surrounds the crucible 5 in the region of the charge 6. A sprue 8 is provided at the bottom of the crucible 5 to allow the molten material 6 to be emptied therefrom into a mould arrangement 9 which consists of four moulds 9A connected together. Only two of the moulds 9A are shown in FIG. 1. The mould arrangement 9 is arranged directly below the sprue 8 in the mould chamber 3. The mould 9 has an open top 10 to receive the molten material when the sprue 8 is opened. Heating elements 11 surround the mould 9 to ensure that the material remains molten while the mould is being filled. A seed or starter (not shown) is arranged at the bottom of each mould to commence the crystallisation of the molten material as it solidifies.

The mould arrangement 9 has an open top 10 to receive molten material from the crucible 5. When the sprue 8 is opened, the molten material 6 pours out of the crucible 5 into the centre of the mould arrangement 9 via the open top 10 and then fills each mould 9A.

The bottom of each of the moulds 9A is provided with a starter to initiate crystallisation of the molten material upon cooling. The starter can be a seed, a point starter or a spiral starter.

The mould arrangement 9 is disposed on a mould support comprising a chill plate 12, an hydraulic ram 14 and conduits 13A, 13B within the ram 14. Cooling water can be supplied to, and discharged from, the chill plate 12 via the conduits 13A, 13B.

When the mould is filled with the molten material, the ram 14 is moved downwardly by the hydraulic actuating means, taking with it the chill plate 12 and the mould arrangement 9 thereon. At the same time, cooling water is passed through the conduits 13A, 13B. Cooling of the material in each mould 9A commences from the starter or seed at the bottom of each mould 9A and a solidification front is formed which moves vertically upwardly through the material in the respective mould 9A, until all the material therein has solidified.

When the above casting operation is finished, the mould arrangement 9 is removed and the castings therein taken for further treatment elsewhere.

The above described method and apparatus are particularly suitable for forming component from single crystals. A problem associated with the above described method when used in forming components as single crystals, is that it is possible only to cast a small number of castings in a single operation. This is economically undesirable, and it would be preferred if the castings could be formed on a much larger scale, for example by providing a larger chill plate 12 to support a larger number of moulds. However, with a chill plate having a large surface area, the thermal gradient of cooling varies from the central moulds to the outer moulds. As a result, the material in the moulds at or towards the edge of the chill plate tends to solidify much faster than the material in the moulds towards the centre of the chill plate. This causes the solidification front in each successive mould further from the centre to be angled relative to the vertical axis of each mould. This can cause problems in single crystal casting operations since it is possible for some of the features of the casting to form as separate crystals from the main crystal. Such castings are unusable and would need to be scrapped.

Figure 2:
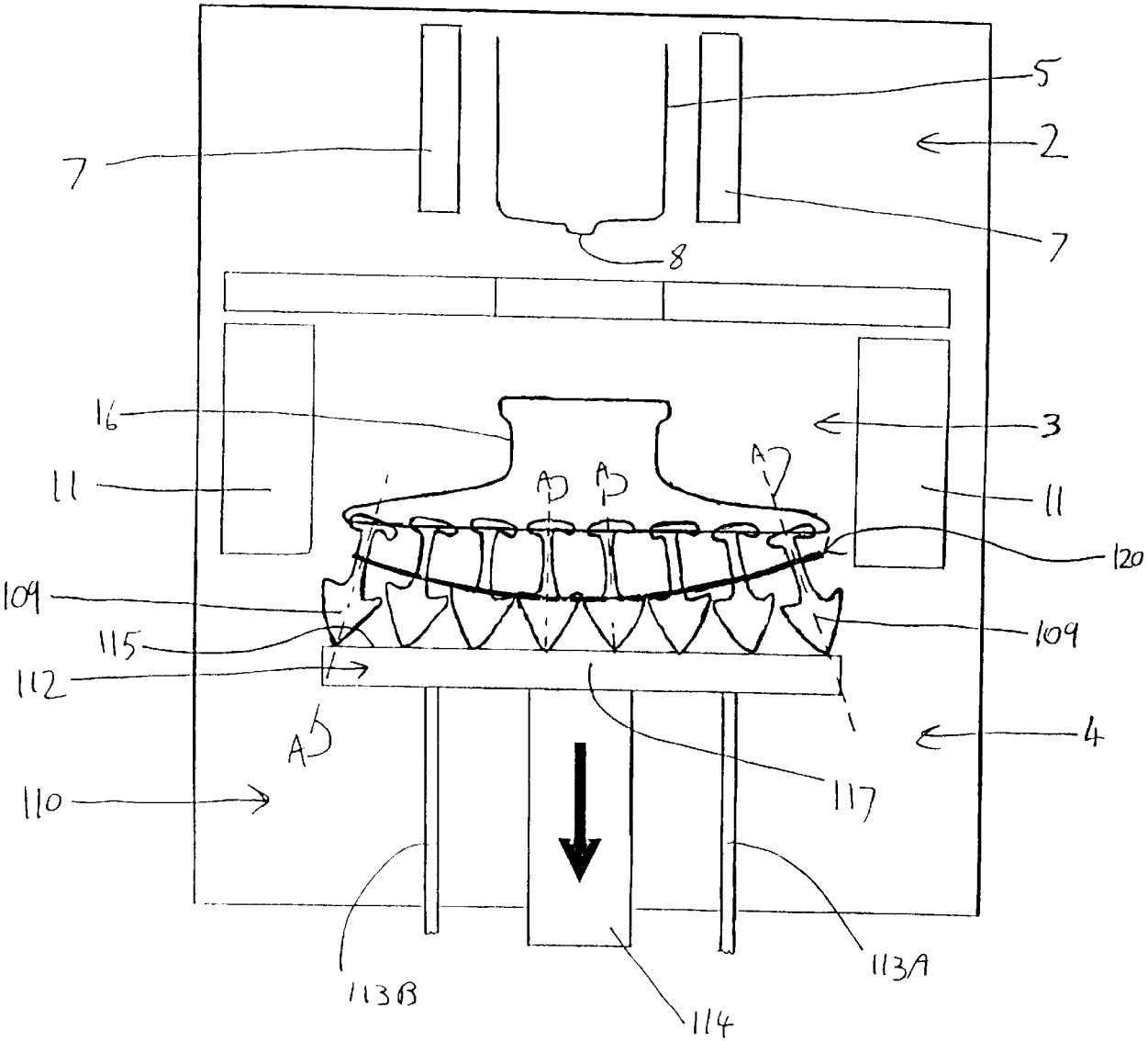
FIG. 2 is a schematic diagram showing a first embodiment of a casting apparatus according to the invention.
Figure 3:
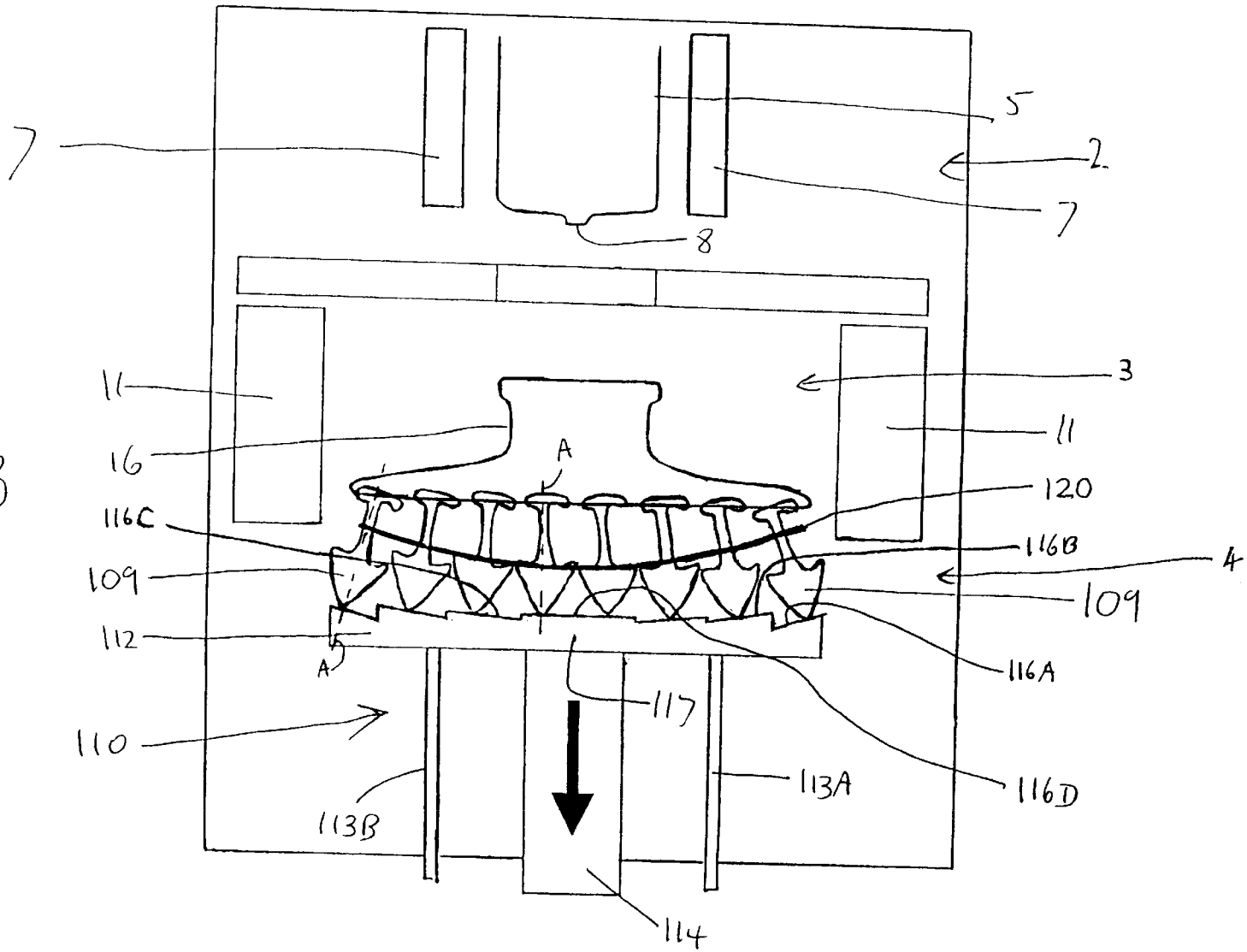
FIG. 3 is a schematic sectional side view of a further embodiment of casting apparatus according to the invention.
Figure 4:
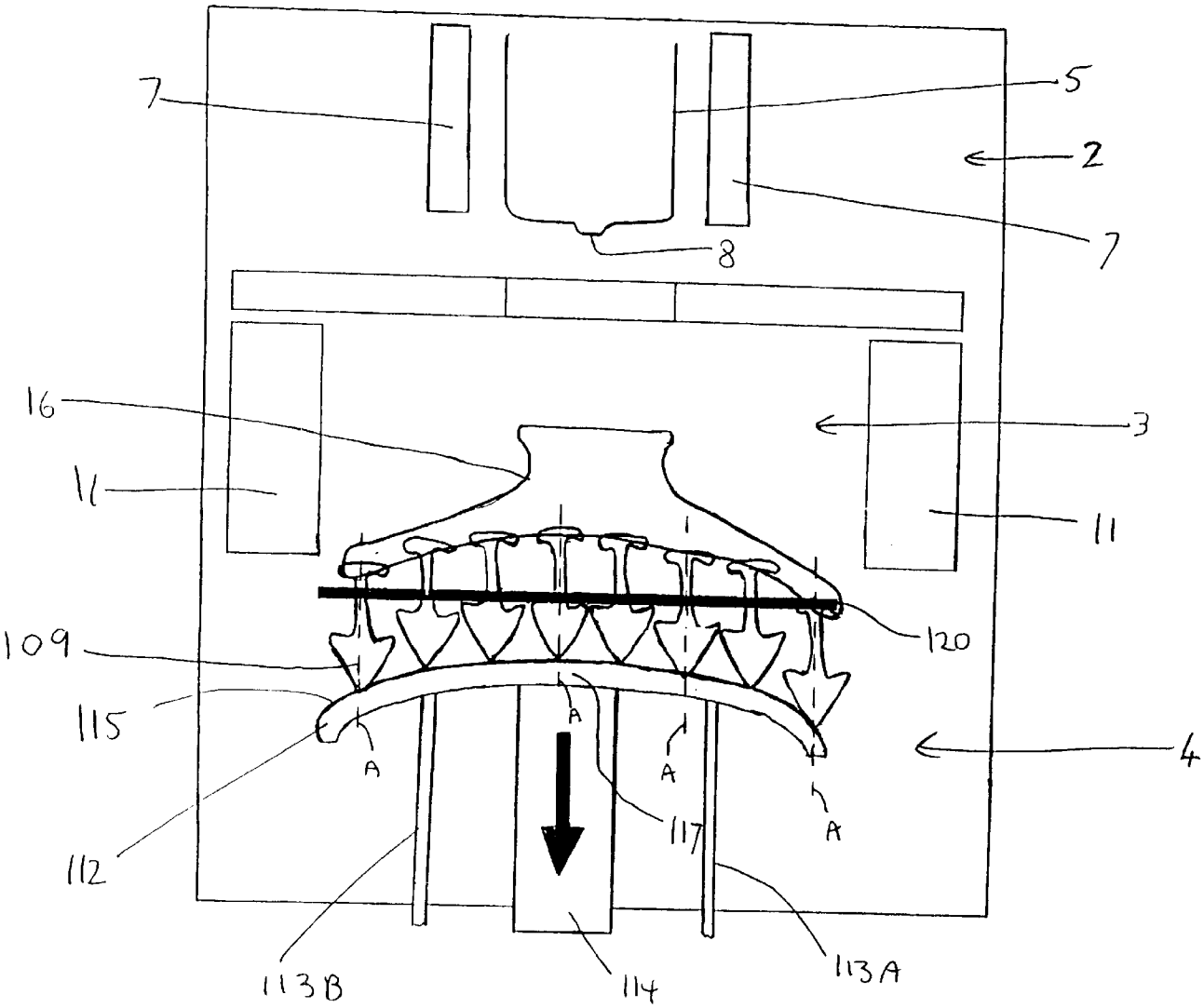
FIG. 4 is a schematic sectional side view of another embodiment of casting apparatus according to the invention.

FIGS. 2–4 show a way in which this problem can be overcome.

Referring to FIG. 2, there is shown schematically, casting apparatus comprising a melting chamber 2, a mould chamber 3, and a withdrawal chamber 4. A crucible 5 for holding a charge of material 6 is provided in the melting chamber 2 which is heated by heating elements 7. When heated, the molten material passes out of the sprue 8 into the mould chamber 3. A mould support arrangement 110 comprising a chill plate 112, an hydraulic ram 114, supply and discharge cooling water conduits 113A, 113B, and a manifold 16 is arranged beneath the crucible 5. The chill plate 112 is, initially, arranged within the mould chamber 2 such that a plurality of moulds 109 are arranged thereon inside the mould chamber 2. The manifold 16 is arranged such that the tops of each of the moulds 109 is in fluid communication therewith and molten fluid from the crucible 5 can flow into each of the moulds 109. Heating elements 11 ensure that the material remains molten while the moulds 109 are being filled.

The chill plate 112 comprises carrying means in the form of a planar, generally circular support surface 115 which supports the plurality of moulds 109. The moulds 109 are arranged in a plurality of concentric circular arrays on the circular support surface 115 about a central region 117 of the chill plate 112.

Each of the moulds 109 defines a main central axis A. For the sake of clarity the axis A is shown only for some of the moulds 109 on the chill plate 112. The moulds 109 are arranged on the chill plate 112 such that successive moulds 109 at increasing distances from the central region 117 are inclined at a greater relative angle relative to each other than moulds 109 closer to the central region 117. As can be seen the inclined moulds 109 are inclined towards the central region 117 of the chill plate 112.

The moulds 109 are inclined on the chill plate 112 such that the axis A of each mould is generally perpendicular to the solidification front formed therein. The curved line 120 in FIG. 2 is a convenient representation of the overall shape of all the individual solidification fronts in all the moulds taken together. The curved line 120 is herein referred to as "the overall solidification front". As can be seen, the overall solidification front 120 has a curved configuration with the edges being higher than the centre. This is a result of the fact that heat transfer in the moulds 109 towards the edges is greater than at the centre. Thus, by ensuring that each of the moulds 109 is inclined such that its main axis A is perpendicular to the solidification front in the respective mould 109, the likelihood of separate crystals forming during solidification is significantly reduced.

The moulds 109 are held in their inclined position by the manifold 16 which engages each mould 109 and holds it in the appropriate position. With the moulds 109 arranged as shown in FIG. 2 it is preferred to use a spiral starter, since these can be oriented in alignment with the mould.

In FIG. 2, the chill plate 112 is shown partially withdrawn into the withdrawal chamber 4 for cooling. In the embodiment shown in FIG. 2, the cooling water inlet 113A and the outlet 113B extend to the chill plate 112 externally of the ram 114.

Referring to the embodiment shown in FIG. 3, there is shown a similar apparatus to that shown in FIG. 2 and the same features have been designated with the same reference numeral. The embodiment shown in FIG. 3 comprises a chill plate 112 having a generally circular support surface 115. The support surface 115 has a stepped configuration comprising a plurality of concentric arrays of inclined support faces 116A, B, C and D upon which the moulds 109 are arranged.

As can be seen, the central support face 116A is generally horizontal, the neighbouring support face 116B is inclined upwardly relative to the horizontal, the support face 116C is more steeply inclined upwardly than the surface 116B, and the outer support face 116D is more steeply inclined upwardly than the support face 116C.

Each of the moulds 109 is arranged on the faces 116A to D such that its axis A is perpendicular to the respective support face, and successive moulds 109 at increasing distances from the central region 117 of the chill plate 112 are inclined relative tot he horizontal towards the central region 117 in the same way as shown in FIG. 2. The inclination of each of the moulds 109 is such that the solidification front in the material in each mould 109 extends generally perpendicular to the axis A of the respective mould 109.

In the embodiment shown in FIG. 3, each of the moulds 109 is arranged on the respective support faces 116A to D such that its axis A extends perpendicular to the support faces 116A, B, C or D. As a result, a seed starter could be used as well as a spiral or point starter. In this embodiment, the manifold 16 may also hold the moulds 109 in position.

Referring to FIG. 4, there is shown a further embodiment having many of the same features as the embodiments shown in FIGS. 2 and 3, and these have been designated with the same reference numeral. The embodiment shown in FIG. 4 differs from the embodiment shown in FIGS. 2 and 3 in that the chill plate 112 has a convex support surface 115. The moulds 109 are arranged with their main axes A generally vertical and, as can be seen, successive moulds 109 at increasing distances from the central region 117 are arranged at a lower level on the support surface 115 than moulds 109 closer tot he central region 117. The moulds 109 are held in their positions on the chill plate 112 by the manifold 16.

In this embodiment, the convex curvature of the support surface 115 is selected such that the overall solidification front 120 extends generally horizontally through the plurality of moulds 109. As a result, the individual solidification front of the material in each mould 109 extends generally perpendicular to the generally vertical axis A of each respective mould 109.

Figure 5:
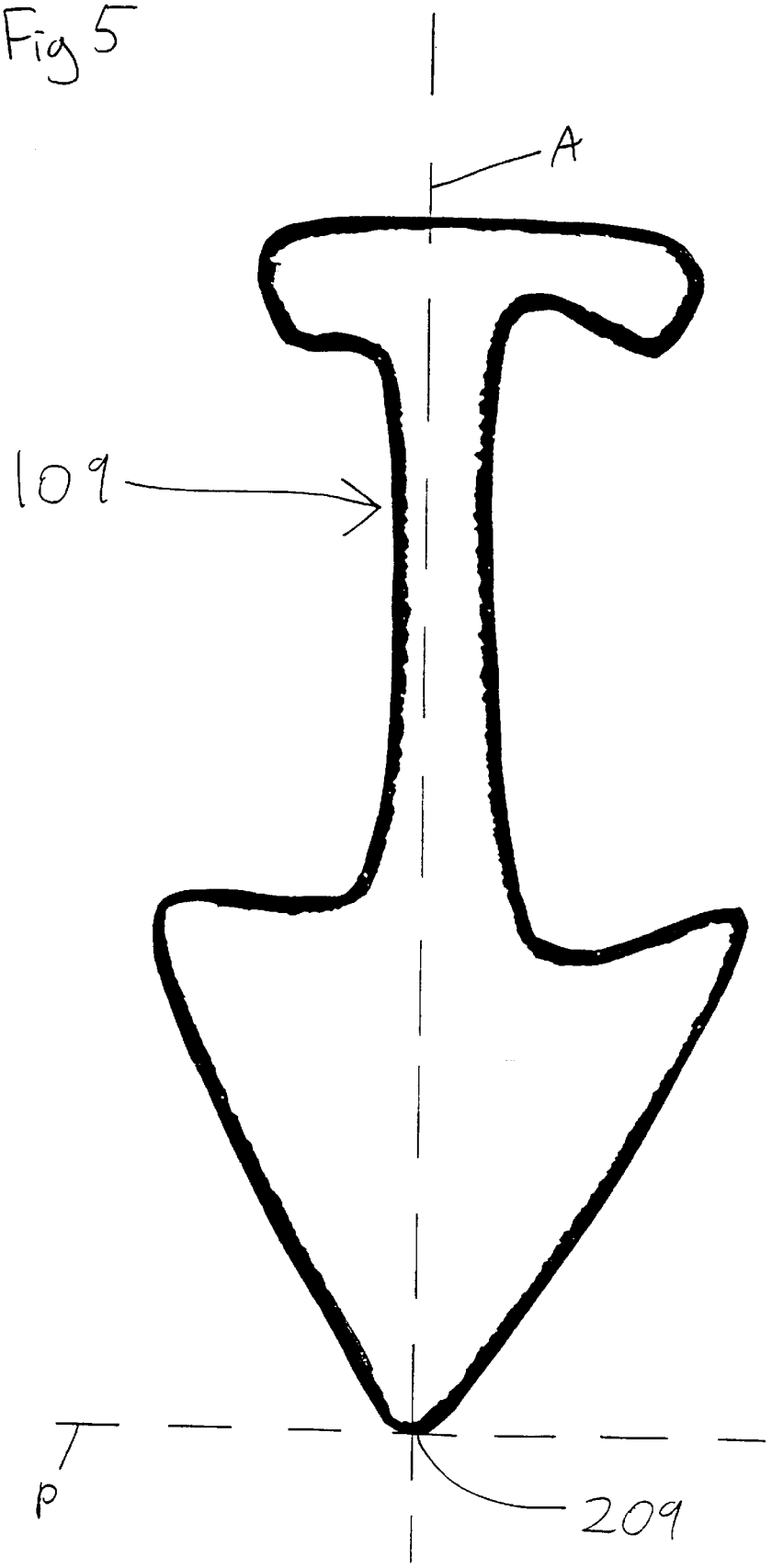
FIG. 5 is a close up side view of a mould.

Referring to FIG. 5, there is shown a single mould 109 having a base 209. The main axis A, and an imaginary plane P, extending perpendicular to the main axis A, are drawn on the mould 109 in FIG. 5. The plane P extends through the base 209 of the mould 109.

A linking feature between the above described embodiments is that, in each case, the planes P of successive moulds 109 arranged at increasing distances from the central region 117 of the chill plate are not co-planar with the planes P of the moulds closer to the central region.

In the case of the embodiments shown in FIGS. 2 and 3 the planes P of moulds 109 further from the central region 117 are inclined relative to the planes P of moulds 109 closer to the central region. In the case of FIG. 4, the planes P of moulds 109 further from the central region 117 are at a lower level than the planes P of moulds 109 closer to the central region 117.

There is thus described in respect of the preferred embodiments, a construction of mould supports, for supporting a plurality of moulds 109 such that a large number of components can be cast in one operation using single crystal casting techniques which have a solidification front in each mould which extends generally perpendicular to the main axis A of the mould 109.

Various modifications can be made without departing from the scope of the invention, for example, the convex chill plate shown in FIG. 4 could be of a stepped configuration. Also, the support surface 115 could be concave, in which case the moulds would be more inclined towards the central region thereof. Although, as described above, method and apparatus are particularly suitable for forming castings as single crystals, they can also be used in directionally solidified casting.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A mold support arrangement for supporting a plurality of moulds in a casting apparatus having a first zone for introducing molten metal into the mold and a second zone in which the material in the mold can cool, the mold support arrangement being capable of relative movement from the first zone to the second zone thereby forming a solidification front in the material in each mold, which solidification front moves through the material as the material solidifies, each mold defining a main axis along which the solidification front can move and a plane perpendicular to the main axis at the base of the mold, the mold support arrangement comprising support means to support the molds such that the aforesaid planes of successive molds at increasing distances from a central region are inclined at a greater relative angles relative to each other than molds closer to the central region, and such that the main axis of each mold extends substantially perpendicular to the solidification front to be formed therein.

2. A mould support arrangement according to claim 1 wherein the main axes of the aforesaid successive moulds are inclined relative to each other.

3. A mould support arrangement according to claim 1 wherein the support means has a geometry such that successive moulds arranged at increasing distances from a central region of the support means are arranged at successively lower levels thereon.

4. A mold support arrangement for supporting a plurality of moulds in a casting apparatus having a first zone for introducing molten metal into the mold and a second zone in which the material in the mold can cool, the mold support arrangement being capable of relative movement from the first zone to the second zone thereby forming a solidification front in the material in each mold, which solidification front moves through the material as the material solidifies, each mold defining a main axis along which the solidification front can move, the mold support arrangement comprising support means to support the molds such that the main axes of successive molds at increasing distances from the central region of the support means are inclined at a greater relative angles relative to each other than molds closer to the central region, and such that the main axis of each mold extends substantially perpendicular to the solidification front to be formed therein.

5. A mould support arrangement according to claim 2 wherein the aforesaid successive moulds are inclined relative to the horizontal by increasing amounts relative to the distance of the mould from the central region of the support means.

6. A mould support arrangement according to claim 5 wherein at least some of the moulds are inclined inwardly towards the central region of the support means.

7. A mould support arrangement according to claim 5 wherein at least some of the moulds are inclined outwardly away from the central region of the support means.

8. A mould support arrangement according to claims 1, wherein the support means comprises carrying means having a generally planar surface upon which the moulds can be arranged.

9. A mould support arrangement according to claim 1, wherein the support means includes carrying means having a plurality of support faces thereon the support faces being inclined to the horizontal.

10. A mould support arrangement according to claim 9 wherein successive support faces at increasing distances from the central region of the carrying means are inclined relative to the horizontal by increasing amounts.

11. A mold support arrangement for supporting a plurality of moulds in a casting apparatus having a first zone for introducing molten metal into the mold, and a second zone in which the material in the mold can cool, the mold support arrangement being capable of relative movement from the first zone to the second zone thereby forming a solidification front in the material in each mold, whereby the solidification front moves through the material as the material solidifies, each mold having a main axis, the mold support arrangement comprising support means to support the molds such that the successive molds at increasing distances from a central region are arranged at a lower level on the support surface than molds closer to the central region, and such that the main axis of each mold extends substantially perpendicular to the solidification front to be formed therein, wherein the support means includes carrying means upon which the molds are arranged, the carrying means having generally convex curved surface.

12. A mould support arrangement according to claim 11 wherein the carrying means comprises a generally convex curved surface.

13. A mould support arrangement according to claim 11 wherein the carrying means includes a plurality of stepped support faces, successive support faces at increasing distances from the central region of the carrying means being arranged at successively lower levels.

14. A mould support arrangement according to claim 13 wherein each of the stepped faces is substantially horizontal.

15. A mould support arrangement according to claim 8 wherein the support means includes holding means to hold the moulds in their arrangement on the carrying means.

16. A mould support arrangement according to claim 15 wherein the holding means comprises a distribution member to distribute the molten material to each of the moulds, the distribution member including engagement means to engage the moulds and hold them on the carrying means.

17. A mould support arrangement according to claim 16 wherein the distribution member comprises a distribution manifold.

18. A mould support arrangement according to claim 8, wherein the carrying means includes a chill plate and cooling means to cool the chill plate.

19. A mould support arrangement according to claim 18 wherein the cooling means comprises supply means to supply a cooling fluid to the chill plate, and discharge means to discharge said cooling fluid from the chill plate.

20. Casting apparatus comprising a mould support arrangement as claimed in claim 1, a first zone for introducing molten material into the mould, and a second zone which the material in the mould can cool, and means for moving the mould support from the first zone to the second zone to effect solidification of the material in the mould.

* * * * *